United States Patent [19]

Swain et al.

[11] 4,343,216

[45] Aug. 10, 1982

[54] SERIAL INTERFACE CIRCUIT FOR AN ELECTRONIC MUSICAL INSTRUMENT

[75] Inventors: Richard S. Swain, Niles; Douglas Moore, Vernon Hills, both of Ill.

[73] Assignee: Norlin Industries, Inc., White Plains, N.Y.

[21] Appl. No.: 157,561

[22] Filed: Jun. 9, 1980

[51] Int. Cl.[3] ..... G10B 3/10; G10F 5/00

[52] U.S. Cl. ..... 84/1.01; 84/115; 84/345; 84/370

[58] Field of Search ..... 84/1.01, 1.03, 345, 84/370, 115

[56] References Cited

U.S. PATENT DOCUMENTS

| | | | |
|---|---|---|---|
| 3,810,106 | 5/1974 | Nadler et al. | 84/1.01 X |
| 3,926,087 | 12/1976 | Griffis | 84/345 |
| 3,926,088 | 12/1976 | Davis et al. | 84/1.01 X |
| 3,929,051 | 12/1976 | Moore | 84/1.01 X |
| 4,184,400 | 1/1980 | Niimi | 84/1.03 |
| 4,201,105 | 5/1980 | Alles | 84/1.01 |
| 4,202,234 | 5/1980 | Comerford | 84/1.01 |
| 4,294,155 | 10/1981 | Turner | 84/1.01 |

*Primary Examiner*—Stanley J. Witkowski
*Attorney, Agent, or Firm*—Ronald J. Kransdorf; Jack Kail

[57] ABSTRACT

An electronic musical instrument includes a programmed microprocessor for controlling selected functions of the instrument and a plurality of key and tab switches responsive to a scan control signal repetitively scanning the switches for developing a serial data signal defining operated key and tab switches during each of the scans. An interface circuit is interposed between the key and tab switches and the microprocessor for developing the scan control signal and for receiving the resulting serial data signal. The serial interface circuit includes means for converting the received serial data into a number of first multibit words each representing a depressed key and a number of second multibit words each bit of which represents the operational condition of a respective one of the tab switches. The first and second multibit words are stored in a RAM in a compressed format, the RAM being enabled for coupling its contents in parallel form to the microprocessor in response to two consecutive scans of the key and tab switches resulting in the development of identical serial data signals immediately preceded by a scan resulting in the development of a serial data signal different therefrom. The interface circuit also includes means for converting data words coupled to the RAM from the microprocessor into a corresponding serial data output signal.

7 Claims, 7 Drawing Figures

SERIAL INTERFACE CIRCUIT FOR AN ELECTRONIC MUSICAL INSTRUMENT

BACKGROUND OF THE INVENTION

The present invention relates generally to electronic musical instruments, such as electronic organs. More specifically, the invention concerns methods and circuits employed in such instruments for interfacing the key and tab switches thereof with a suitably programmed general purpose microprocessor.

General purpose microprocessor chips are being employed in electronic apparatus intended for the consumer market at an ever increasing rate largely as a result of the dramatic cost reduction in these chips over the past few years. For example, electronic organ manufacturers are beginning to use these low cost microprocessor chips to perform many functions heretofore necessitating the use of large amounts of relatively costly hard-wired logic circuits. As a result, many features previously available only on higher priced electronic organs are now being found on lower cost models.

However, in order to make the most efficient use of the computational capabilities of the microprocessor, it has been found necessary to provide an interface between the microprocessor and the player manipulable inputs to the organ. These player manipulable inputs include key and pedal switches which control the pitch of the generated audio signals as well as various other switches such as tab, toggle, or pushbutton switches (all of which will hereafter be collectively referred to as tab switches) which control the voicing circuits of the organ as well as various automatic features such as automatic rhythm accompaniment. In order to couple data from the operated key and tab switches, a time multiplexed scanning technique is frequently employed whereby the switches are sequentially scanned in response to a sequentially incremented multibit scan control signal for generating a serial data signal composed of a series of consecutive time slots each corresponding to one of the scanned switches. The development of a logical 1 signal in a particular time slot represents the depression or operation of the corresponding switch while a logical 0 signal indicates that the switch is not depressed or operated. U.S. Pat. No. 3,929,051 to Moore, which is incorporated herein by reference, is exemplary of such scanning systems. It has been determined that most currently available general purpose microprocessor chips are not operable at sufficiently fast rates, considering the many other computational operations which must be performed, to adequately accomplish this scanning operation. Therefore, it would be highly desirable to provide a circuit interfacing between the player manipulable switches of the organ and the microprocessor for performing the scanning operation. In addition, since the microprocessor is responsive to input data in parallel form, means must be provided to convert the serial data indentifying an operated switch to a parallel signal having a corresponding value. Also, it would be desirable to debounce the input serial data before transferring the corresponding parallel data to the microprocessor to provide a high degree of confidence that the data is valid.

The present invention provides a serial interface circuit capable of realizing the foregoing functions and which processes the serial data produced by key switches in a different manner from the serial data produced by the tab switches to minimize required memory capacity. More specifically, the interface circuit of the invention comprises a plurality of sequentially operated logic components including a set of registers operated thereby and a random access memory (RAM). Serial data representing operated key switches is coupled to the interface circuit in response to the development of an output scan control signal and is converted to multibit signals each representing the time encoded position of a depressed key. The multibit signals are stored in consecutive memory locations in a first section of the RAM in a compressed format. That is, if a depressed key is released, the memory location previously occupied by its corresponding multibit signal is replaced with a multibit signal corresponding to a depressed key so that, beginning from the initial memory location of the first section of the RAM, data continues to be stored in consecutive memory locations. The multibit signals representing depressed keys are transferred to the microprocessor from the RAM only after three scans of the key and tab switches has been completed, namely; two consecutive scans representing identical serial data immediately preceded by a scan representing different serial data. As a result, a level of confidence is achieved that valid data is being read into the microprocessor which was generated in response to key and tab switch depressions and not in response to switch bounce. Serial data representing operated tab switches is stored in a second section of the RAM. In particular, each tab switch is represented by a single bit of an eight bit stored word, a logical 1 bit representing an operated tab switch and a logical 0 bit representing an undepressed tab switch. In response to the debounce criteria described above being satisfied, each eight bit word is sequentially transferred from the RAM to the microprocessor. The RAM includes a third section for storing data transferred thereto from the microprocessor. This data is converted by the interface circuit to a serial form which can be used for controlling various circuits of the organ.

DESCRIPTION OF THE PREFERRED EMBODIMENT

Figure 1:
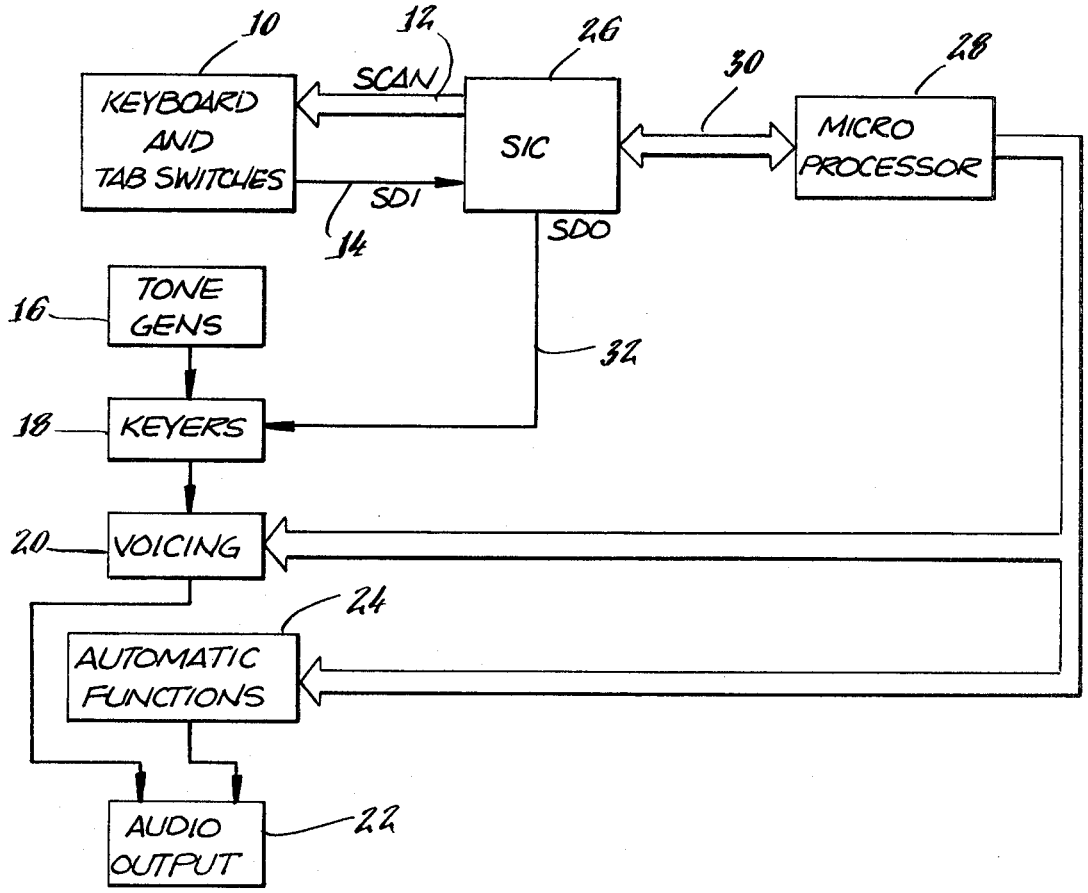
FIG. 1 is a block diagram illustrating the use of the serial interface circuit of the present invention in association with an electronic musical instrument including a general purpose microprocessor.

Referring to FIG. 1, which is a block diagram illustrating the utility of the present invention, an electronic musical instrument such as an electronic organ includes a keyboard consisting of a plurality of keys and associated key switches as well as a plurality of tab or pushbutton switches, the keyboard tab and pushbutton switches being represented by a block identified by reference numeral 10. The key and tab switches 10 are scanned in a conventional manner in response to an 8-bit scan signal supplied on a scan bus 12 for encoding the key and tab switches by a time division multiplexing scheme into a repetitive sequence of serial data streams which are developed on an output conductor 14. In this scanning operation, which is entirely conventional, each serial data stream developed on output conductor 14 consists of a plurality of time displaced serial data pulses defining the depressed key and tab switches 10 during the associated scan. More particularly, each scan of the key and tab switches 10 is divided into a sequence of consecutive time slots, each respective time slot corresponding to the depression of a particular key or tab switch 10. Thus, the development of a serial data pulse on output conductor 14 defines the depression of a particular key on the keyboard or the operation of a particular one of the tab switches.

The organ further typically includes apparatus 16 for generating a plurality of tone signals and a plurality of keyers 18 coupling selected tone signals through a voicing unit 20 to an audio output unit 22. The tone signals coupled by the keyers 18 is usually determined according to the depressed keyboard keys while the voicing unit 20 is controlled by the operated tab switches for modifying the characteristics of the tone signals in a desired manner. The audio output unit 22 normally includes one or more output amplifiers for increasing the level of the audio signals coupled thereto and a speaker for converting the audio signals into audible tones. The organ may yet further include one or more automatic functions 24 operated under the control of the tab switches for providing various automatic features. Automatic rhythm accompaniment and single key chord generation are exemplary of such features.

Low cost general purpose microprocessor chips have recently become available and are being used by organ manufacturers in place of hard-wired logic circuits to perform many of the operations necessary to control, for example, the automatic functions 24 as well as the voicing unit 20. One disadvantage of such general purpose microprocessor chips is that they operate at a speed which, considering the many other computational operations which must be performed, is not suitable for developing the scan signals on bus 12 for scanning the key and tab switches 10. Therefore, according to the present invention, the electronic organ shown in FIG. 1 includes a serial interface circuit 26 interposed between the key and tab switches 10 and a general purpose microprocessor 28. The serial interface circuit 26 is operable at a relatively high speed for developing scan signals on the bus 12 for scanning the key and tab switches 10 and for suitably processing the serial data developed on output conductor 14. More specifically, the serial interface circuit 26 couples representations of the serial data developed on output conductor 14 to the microprocessor 28 in a parallel format over a bi-directional data bus 30 and also develops a serial data output signal on a conductor 32 which may be used for controlling certain elements of the organ such as the keyers 18. As will be explained in further detail hereinafter, the serial interface circuit 26 processes data supplied by the key and tab switches 10 in a particularly efficient format and also includes apparatus for debouncing the operated key and tab switches 10. Another important feature of the serial interface circuit 26 is that operation of the microprocessor 28 is interrupted for receiving key and tab switch information to a minimum extent and only when necessary to reflect a change in the operation of the organ.

Figure 2:
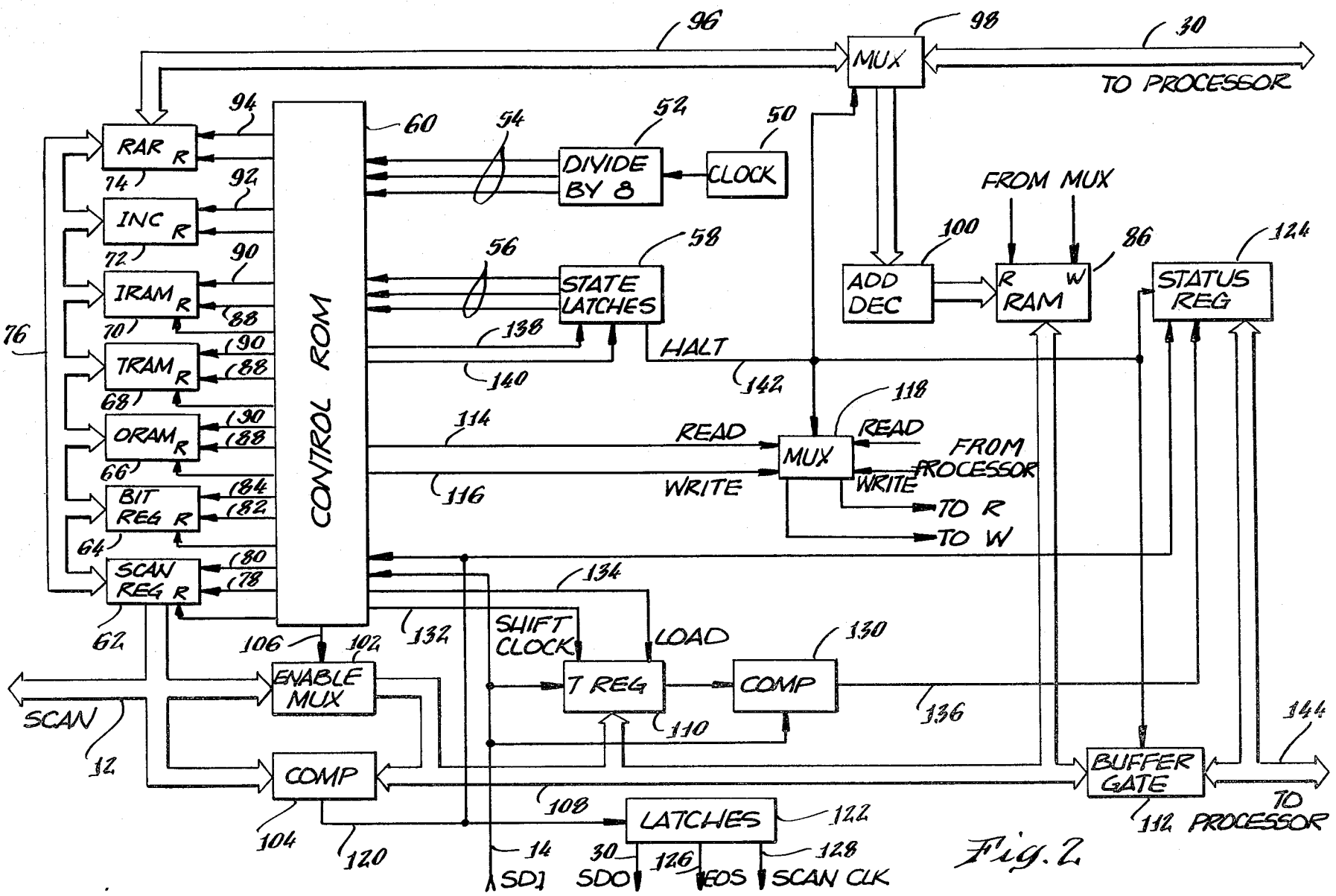
FIG. 2 is a detailed block diagram illustrating the serial interface circuit of the present invention.

The serial interface circuit 26 is shown in more detail in the block diagram of FIG. 2. Referring, therefore to FIG. 2, the serial interface circuit 26 comprises a clock 50 coupling a high frequency clock signal to the input of a divide by 8 circuit 52. The divide by 8 circuit 52 includes three output conductors 54 which, together with the three output conductors 56 of a series of state latches 58 couple address signals to a control ROM 60. The control ROM 60 is suitably configured for developing a plurality of control signals which are developed in a particular time sequence for controlling the operation of diverse circuits comprising the serial interface circuit 26.

The control ROM 60 initially includes a plurality of output conductors controlling the operation of a series of registers 62-74, all of the registers 62-74 being interconnected by a bi-directional bus 76. Register 62 comprises a scan register whose contents, as will be explained in detail hereinafter, are consecutively incremented during each scan of the key and tab switches 10 for developing the scan signal on bus 12. The scan register 62 is loaded with the data present on bus 76 in response to the development of a logical 1 signal on output conductor 78 of control ROM 60 and outputs its contents onto bus 76 in response to the development of a logical 1 signal on output conductor 80 of control ROM 60. Register 64 comprises a three stage bit register which is operated in response to output conductors 82 and 84 of the control ROM 60. As in the case of scan register 62, the development of a logical 1 signal on output conductor 82 of control ROM 60 results in the bit register 64 being loaded with the data present on bus 76 and the development of a logical 1 signal on conductor 84 results in the contents of the bit register 64 being transferred to bus 76.

Figure 3:
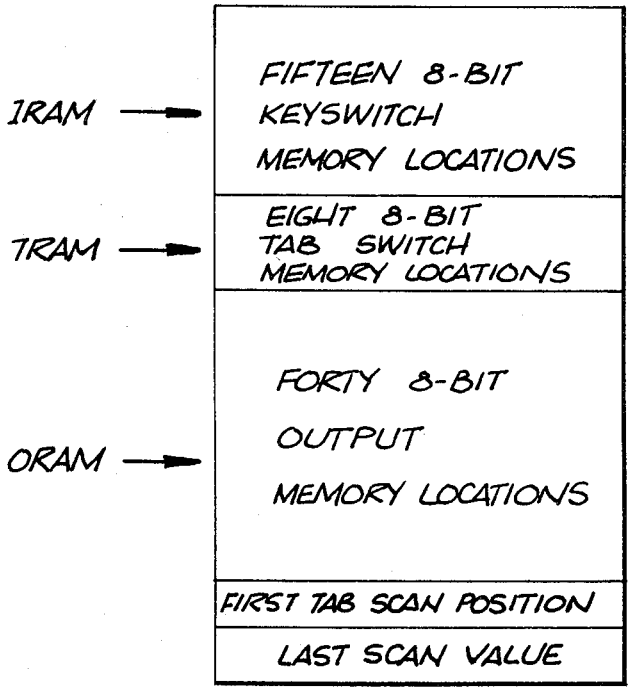
FIG. 3 is a table showing the manner of data storage within the RAM 86 of the serial interface circuit shown in FIG. 2.

Registers 66, 68 and 70 are used as pointers for addressing different sections of a random access memory (RAM) 86. Referring to FIG. 3, the RAM 86 is divided into a series of separate sections. The first section, which is addressed in response to the IRAM register or pointer 70 comprises fifteen 8-bit key switch memory locations, each location being adapted for storing an 9-bit binary number representing a depressed key on the organ keyboard 10. The second section of the RAM 86 comprises eight 8-bit memory locations each addressed in response to the TRAM register or pointer 86. Each of these memory locations is adapted for storing eight bits of information represented the status of eight of the tab switches 10. The final section of RAM 86 comprises forty 8-bit memory locations each adapted for storing an 8-bit binary word coupled to the serial interface circuit 26 by the microprocessor 28. This section of the RAM 86 is addressed in response to the ORAM register or pointer 66. Each of the pointers 66, 68 and 70 is loaded with data present on bus 76 in response to the development of a logical 1 signal on an output conductor 88 of control ROM 60 and couples its contents to bus 76 in response to the development of a logical 1 signal on an output conductor 90 of control ROM 60. The RAM 86 also stores a pair of 8-bit data words defining values referred to as the first tab scan position and the last scan value respectively. These data words are addressed by suitably energizing a two conductor bus 93 connected from the control ROM 60 to address register 74.

Register 72 comprises an increment register adapted for incrementing by a factor of unity the value of the signal present on bus 76 in response to the development of a logical 1 signal on an output conductor 92 of the control ROM 60. Register 74 comprises a RAM address register which is loaded with the data present on bus 76 in response to the development of a logical 1 signal on an output conductor 94 of the control ROM 60. The output of register 74 is coupled by a bus 96 through a multiplexer 98 to the input of an address decoder 100 for addressing the RAM 86. The multiplexer 98 also couples data from the microprocessor 28 over bus 30 to the address decoder 100 for addressing RAM 86.

The operation of registers 62-74, each of which includes a reset input coupled to control ROM 60, will be explained in terms of several exemplary operations. Initially, the scan register 62 must be sequentially incremented in order to develop the scan signal on bus 12. This operation is performed by initially energizing conductor 80 causing the contents of the scan register 62 to be developed on bus 76. Next, conductor 92 is energized whereby the data present on bus 76 is incremented by a factor of unity. As a final step, conductor 78 is energized so that the incremented value is loaded into the scan register and developed on bus 12. As will be explained hereinafter, the bit register 64 may be incremented in a similar fashion. The pointers 66, 68 and 70 operate to address the RAM 86 through the RAM address register 74. In particular, if, for example, it is desired to address the key switch portion of the RAM 86, the conductor 90 connected to the IRAM register 70 is energized for coupling its contents to bus 76. Conductor 94 is thereafter energized whereby the data coupled to the bus 76 by the IRAM register 70 is stored in the register 74. The register 74 then couples this address data over bus 96 and through multiplexer 98 to the address decoder 100 for addressing the corresponding memory location of RAM 86. It will also be appreciated that the IRAM pointer 70, the TRAM pointer 68 and the ORAM pointer 66 may be incremented as desired for addressing different memory locations of RAM 86 in a manner identical to that previously explained with respect to incrementing the scan register 62.

The output of the scan register 62 is also coupled by bus 12 to the input of a second multiplexer 102 and to the first input of an 8-bit comparator 104. In response to the development of a logical 1 signal on an output conductor 106 of control ROM 60, the multiplexer 102 is enabled for coupling the output of the scan register 62 to a bi-directional bus 108 connected to the data input of the RAM 86. The particular memory location at which the data is stored in RAM 86 will, of course, be determined by the current contents of the RAM address register 74. Also, the comparator 104 is operable for comparing the output of the scan register 62 with data read from the RAM 86. In this regard, the control ROM 60 includes an output conductor 114 connected to the read input of RAM 86 and an output conductor 116 connected to the write input of RAM 86 through a multiplexer 118. A logical 1 signal on conductor 116 causes the data on bus 108 to be written into the addressed memory location of the RAM while a logical 1 signal on conductor 114 results in RAM 86 outputting the contents of the addressed memory location onto bus 108. The multiplexer 118 is also operable for coupling similar read and write control signals to the RAM 86 from the microprocessor 28.

Comparator 104 includes an output conductor 120 which goes logically high when the two inputs to the comparator 104 are equal. Conductor 120 is connected to a series of latches 122 and also to one input of a status register 124 which is comprised of a series of flip-flops. Latches 122 develop three output signals as will be described in further detail herein. A first output signal comprises the output serial data developed on conductor 32. A narrow pulse (EOS) is developed on a conductor 126 defining the end of each scan of key and tab switches 10 and a scan clock signal is developed on an output conductor 128.

The T register 110 comprises an eight stage shift register having a serial data input connected for receiving the serial data developed on conductor 14 defining the depressed keys and tabs 10. The serial data developed on conductor 14 is also coupled to an input of the control ROM 60 and to one input of a one bit exclusive NOR comparator 130 whose second input is derived from the serial data output of the T register 110. The T register, whose contents are shifted one position in response to a shift clock signal developed on an output conductor 132 of the control ROM 60, also includes a parallel data input connected to bus 108 which is loaded into the register in response to a load signal developed on an output conductor 134 of the control ROM 60. Comparator 130 includes an output conductor 136 which is connected to a second input of the status register 124 and which goes logically high when the two inputs to the comparator 130 are equal. The equality indicating signals developed on conductors 120 and 136 of comparators 104 and 130 serve to set certain flip-flops within the status register 124 as will be described hereinafter.

The state latches 58 are responsive to control signals developed on a pair of output conductors 138 and 140 of the control ROM 60 for developing address signals on conductors 56 identifying the mode of operation characterizing the serial interface circuit 26. The mode identification defined by the logic signals on conductors 56 serve to select a particular group of sequential memory addresses of the control ROM 60 while the address signals on conductors 54 sequentially step through the selected addresses. A first mode of operation, referred to as the HALT mode, corresponds to the conductors 56 assuming a 000 state. An end of scan (EOS) mode is defined when the state of conductor 56 is 001 and a KEYS mode when the state of conductors 56 is 100. Finally, a TABS mode is represented by a 111 state characterizing the conductors 56. The state latches 58 also produce a HALT signal on an output conductor 142 which is connected to the status register 124 for setting one of its internal flip-flops and to the control input of multiplexers 98 and 118. In response to the absence of a HALT signal on conductor 142, multiplexer 98 is operable for coupling data from bus 96 to the address decoder 100 and is otherwise operable for coupling data to the address decoder from bus 30. Multiplexer 118 is operable for coupling read and write signals from conductors 114 and 116 to the RAM 86 in response to the absence of a HALT signal on conductor 142 and is otherwise operable for coupling read and write signals to the RAM from the microprocessor 28.

The HALT signal developed on conductor 142 is also coupled to the enable input of buffer gate 112. In response to the absence of a HALT signal on conductor 142, buffer gate 112 is maintained in an off state whereby data cannot be coupled therethrough. However, in response to the presence of a HALT signal on conductor 142 buffer gate 112 is enabled whereby data may be coupled to or from the microprocessor 28 over a bi-directional bus 144 to the RAM 86. The bus 144 is also coupled to the status register 124 for controlling the state thereof in a manner to be described hereinafter.

The operation of the serial interface circuit 26 depicted in block diagram form in FIG. 2 may be most conveniently explained in terms of the flow charts of FIGS. 4–7. These flow charts represent the sequential operation of the circuit and do not represent a stored program except insofar as certain operations and decisions include operation of the control ROM 60. Before proceeding with a discussion of the flow charts, it should be pointed out that, as will be explained hereinafter, the IRAM, TRAM and ORAM registers are each reset at the end of each scan of the key and tab switches 10 for pointing to the first memory location of their respective section of the RAM 86. Also, at the end of each scan the bit register 64 is reset to a 0 value.

Figure 4:
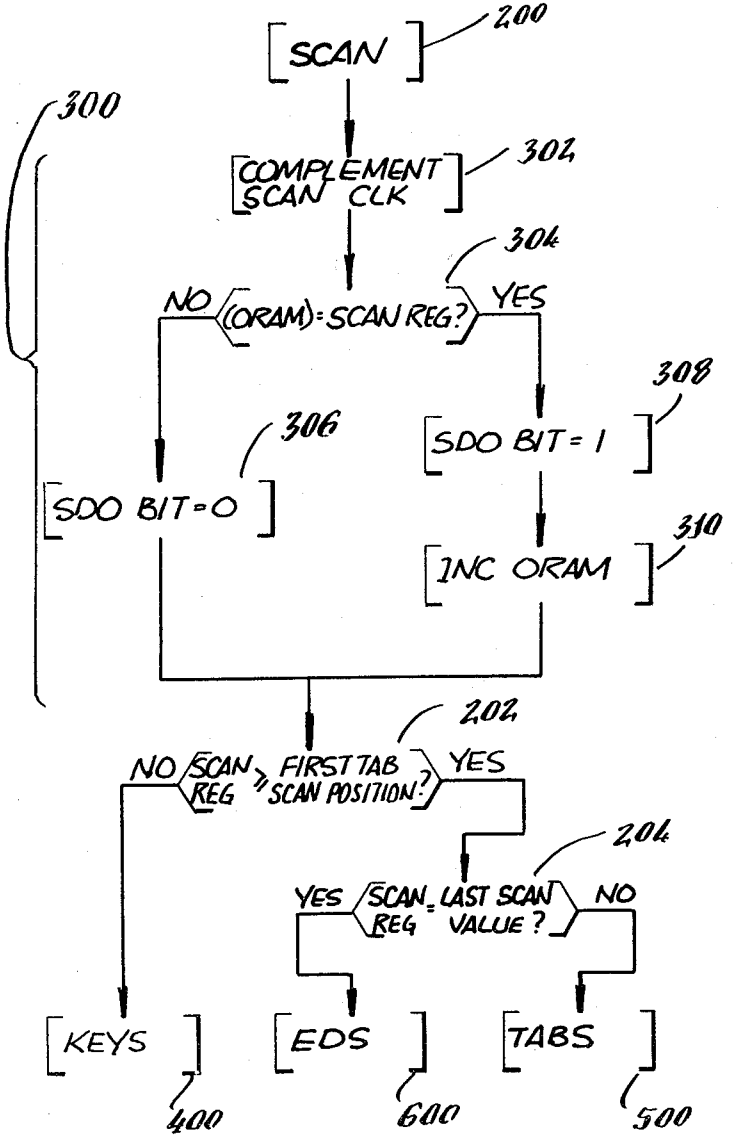

Referring now to FIG. 4, the illustrated flow chart represents in general terms the overall sequential operation of the serial interface circuit 26. The operational sequence is initiated by an operation block 200 representing the step of scanning a first keyboard switch in response to the initial state of the scan register 62. That is, at the beginning of each scan the scan register 62 will have been initialized for developing a signal on bus 12 for interrogating the first key switch of the keyboard. Omitting portion 300 of the flow chart of FIG. 4 for the moment, the circuit 26 makes a decision represented by block 202 as to whether the current state of the scan register is greater than or equal to a data value referred to as the first tab scan position. The first tab scan position represents a value stored in the RAM 86 defining the time encoded position of the first scanned tab switch. Since all of the keys are scanned before the tab switches, the first tab scan position will have a value one time position greater than the last scanned key switch. Accordingly, since the first key switch is presently being scanned, block 202 yields a NO decision whereby the circuit 26 is conditioned for entering the KEYS mode of operation. The comparison decision represented by block 202 is actually performed by the comparator 104 which compares the data on bus 12 with the data coupled to bus 108 from RAM 86 in response to an address signal from register 74. The results of the comparison are coupled by conductor 120 to the control ROM 60 which sets the state latches in the KEYS mode of operation.

Figure 5:
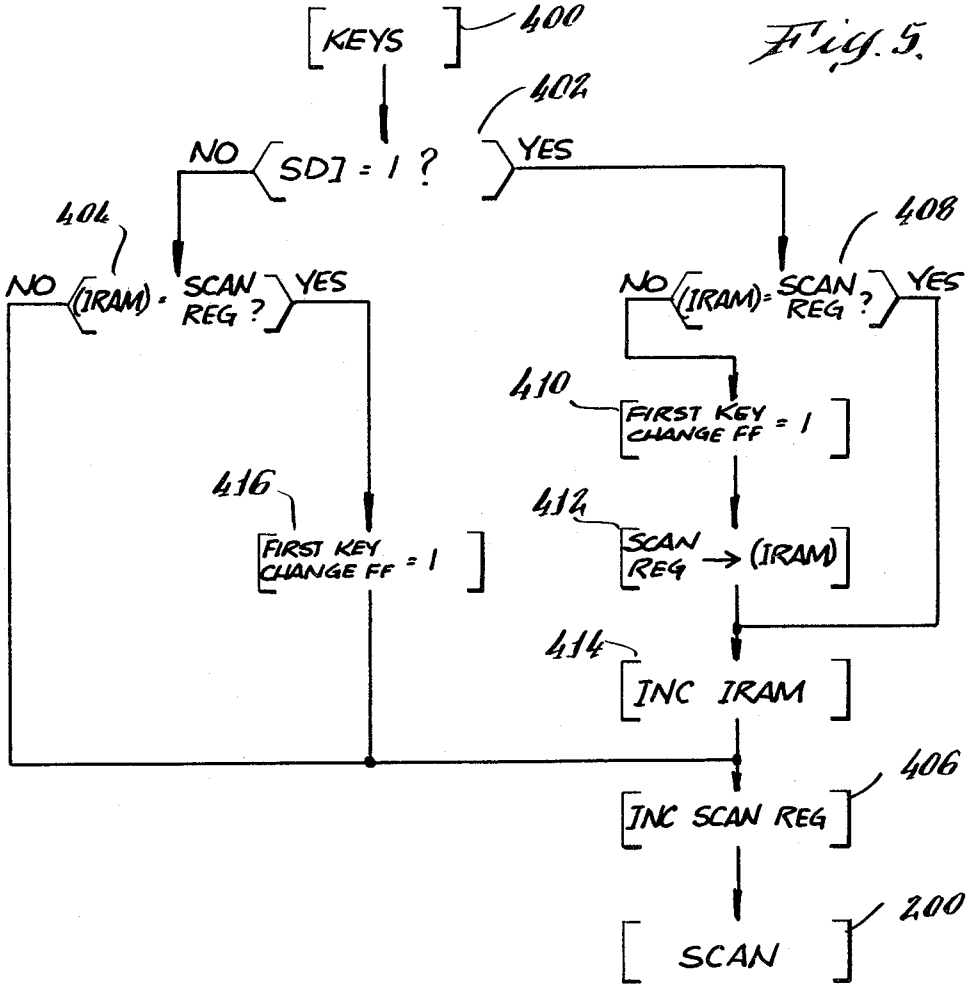
FIGS. 4–7 are flow charts depicting the operational sequences performed by the serial interface circuit of FIG. 2 during its different modes of operation.

The KEYS mode of operation is illustrated by the flow chart of FIG. 5. In this mode of operation, a determination as to whether the currently scanned key switch is depressed is initially made by using the serial data signal developed on conductor 14 as an addition address input to the control ROM 60 (see block 402). If the key is depressed the serial data signal developed on conductor 14 is logical 1 and if the key is not depressed the serial data signal is logical 0. Assuming that the first key is not depressed, a NO decision is made by block 402. Next, a decision is made as represented by block 404 as to whether the first memory location of the key switch section of the RAM is equal to the current state of the scan register 62. Since this memory location was initialized to a 0 value and since the initial state of the scan register is 1, a NO decision is made by block 404. The decision represented by block 404 is implemented by the comparator 104 of FIG. 2 which compares the state of the scan register 62 with the signal developed on bus 108 by RAM 86 in response to an address signal from register 74 representing the initial state of IRAM register 70. The NO decision from block 404 causes an operation to be performed as represented by block 406 wherein the scan register is incremented by a factor of unit for scanning the second key switch. Thereafter, the scan operation represented by block 200 is returned to and again performed.

The foregoing process, i.e. performing the operations and decisions required by blocks 200, 202, 400, 402, 404, 406 and returning to block 200, is continuously repeated until either a depressed key is located or all of the keys have been scanned. Assuming that a key is depressed, a YES decision is made by block 402 in time coincidence with the time encoded position of the depressed key. After block 402 detects a depressed key, decision block 408 requires a determination as to whether the initial memory location of the key switch portion of the RAM 86 is equal to the current state of the scan register 62. As mentioned previously, the initial memory location of the key switch portion of the RAM 86 was initialized to a 0 value. Therefore, since the state of the scan register reflects a value corresponding to the time encoded position of the depressed key a NO decision is made by block 408. As explained previously, the decision represented by block 408 is performed by comparator 104 of FIG. 2.

A NO decision from block 408 requires that an operation represented by block 410 be performed next. Block 410 indicates that a first key change flip-flop be set to logical 1. The first key change flip-flop is one of the flip-flops of status register 124 and is set in response to the signal developed on conductor 120 by comparator 104. Thereafter, the contents of the scan register 62 are transferred through multiplexer 102 and bus 108 to the initial memory location of the key switch portion of RAM 86, which memory location is identified by the initial state of the IRAM pointer 70. The latter operation is represented by block 412. Next, block 414 requires that that the IRAM pointer 70 be incremented by increment register 72 after which the scan register 62 is incremented as represented by block 406 and the next key switch is scanned as represented by block 200.

Assuming that no other keys have been depressed, a YES decision is eventually reached by block 202 when the scan register has been incremented a sufficient number of times so that it is scanning the first tab switch. The next step is to compare the state of the scan register 62 with a value stored in the RAM 86 representing the time encoded position of the last scanned tab. This comparison, which is also effected by comparator 104, is represented by block 204. Since the state of the scan register 62 represents a value corresponding to the time encoded position of the first scanned tab, a NO decision is reached by block 204 and the circuit proceeds to perform the TABS operation as represented by block 500. As previously mentioned, in this mode of operation, the state latches 58 develop a mode control signal of 111 on conductors 56.

Figure 6:
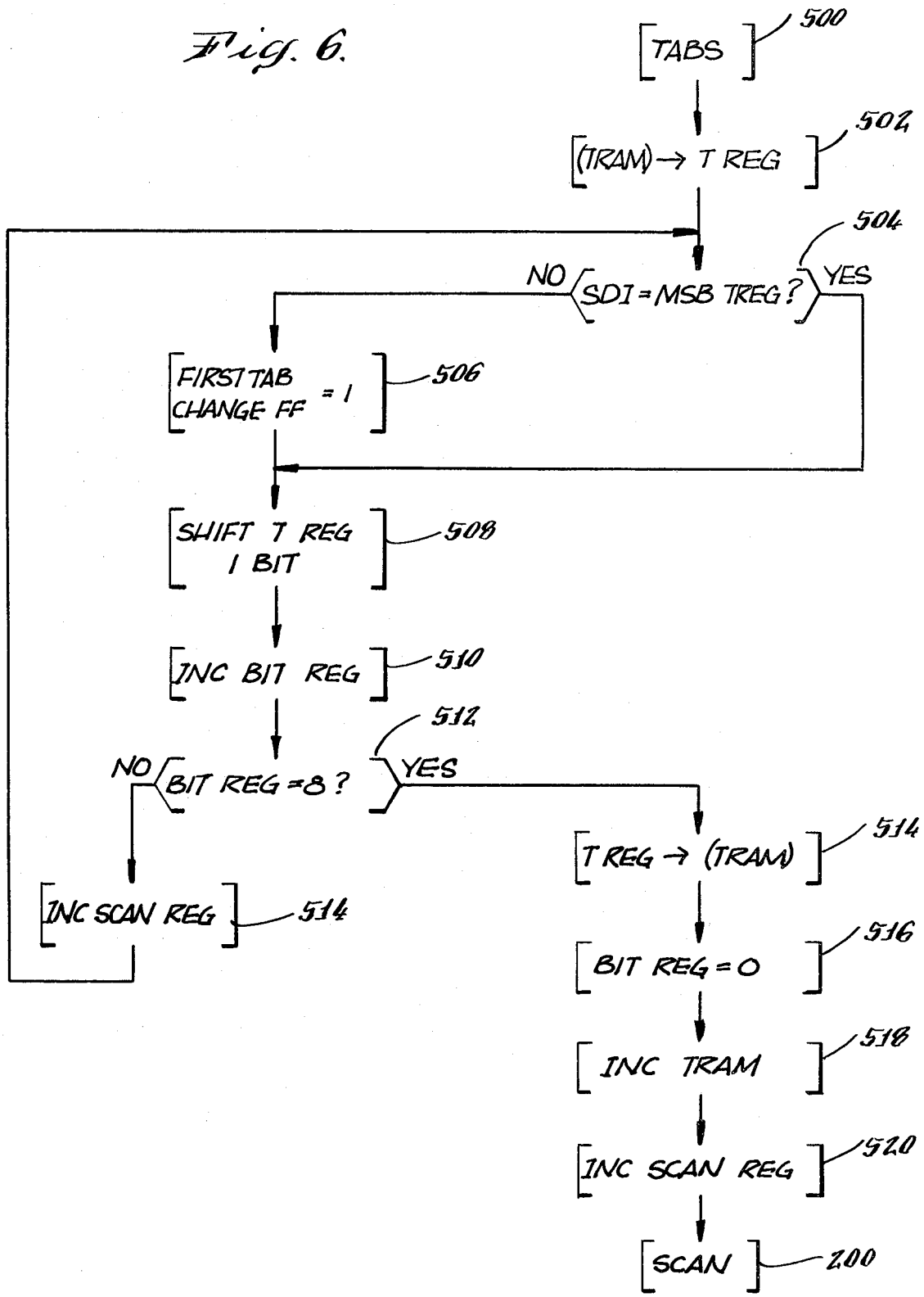

The TABS mode of operation is illustrated by the flow chart of FIG. 6. Initially, an operation represented by block 502 is performed wherein the contents of the initial memory location of the tab switch portion of RAM 86 is transferred to the T register 110. That is, a load pulse is developed on conductor 134 causing the data developed on bus 108 by RAM 86 in response to address register 74, to be loaded in the T register 110. Therefore, since the initial memory location of the tab switch portion of RAM 86 was initialized to a 0 value, the eight stages of the T register 110 are each loaded with a 0 bit. Next, as represented by block 504, the serial data developed on conductor 14 is compared with the most significant bit currently stored in the T register by comparator 130. If the tab switch currently being scanned, i.e. the first tab, is not depressed a YES decision is made by block 504 corresponding to the development of a logical 0 signal on output conductor 136 of comparator 130. Thereafter, a shift pulse is developed on conductor 132, as represented by block 508, causing the contents of the T register 110 to be shifted one place to the right and the current serial data to be entered into the least significant bit position of the register. Subsequently, block 510 requires the bit register 64 to be incremented and then the contents of the bit register are tested to determine whether a value of eight has been reached as represented by block 512. Since the bit register has only been incremented once from its initial 0 value, a NO decision is made by block 512 and the scan register 62 is incremented for scanning the next (i.e. second) tab switch as represented by block 514.

After the operation represented by block 514 has been performed, the operational sequence is returned to decision block 504. If the second tab switch is also not depressed, the circuit again sequences through blocks 504, 508, 510, 512, 514 and again returns to block 504. Assuming that none of the first eight scanned tab switches are depressed, the operations and decisions represented by this loop are repeated six additional times until the bit register has been incremented to a value of eight and a YES decision is made by block 512. This YES decision causes a series of operations to be performed in sequence as represented by blocks 514, 516, 518 and 520. Block 514 represents the operation whereby the contents of the T register, which now represents the eight 0 bits of the serial data developed on conductor 14 representing the non-depression of the first eight scanned tab switches, be transferred to the first memory location of the tab switch portion of the RAM 86 as indicated by the TRAM pointer 68. Next, the bit register 64 is reset to a 0 value as represented by block 516, the TRAM pointer 68 is incremented by a factor of unity as represented by block 518 and the scan register 62 is incremented by a factor of unity as represented by block 520 whereby the first scanned tab switch of the next group of eight scanned switches is scanned as represented by block 200.

The sequential operation of the circuit 26 therefore returns to block 200 of FIG. 4 and proceeds through blocks 202 and 204 to reinitiate the TABS mode 500 as previously explained. If none of the tab switches in the second group of scanned tab switches are depressed the TABS mode of operation as illustrated in FIG. 6 is again performed exactly as described above. Assume, however, that the first tab switch of the second group of eight scanned tab switches is depressed. In this case, the contents of the second memory location of the tab switch portion of RAM 86 (remember that the TRAM pointer 68 was previously incremented in accordance with block 518) is transferred to the T register whose eight stages are each characterized by a 0 value bit. With respect to block 504, since the serial data signal on conductor 14 is logical 1 and the most significant bit of the T register is logical 0, a NO decision is reached causing a logical 1 signal to be developed on conductor 136 whereby a first tab change flip-flop of status register 124 is caused to be set to logical 1 by a block 506. Thereafter, the operations and decisions represented by blocks 508, 510, 512 and 514 are performed as described previously and the operational sequence is returned to block 504. Assuming none of the next seven tab switches are depressed, a YES decision is made by block 504 in response to scanning these next seven tab switches and the operations and decisions represented by blocks 508, 510, 512 and 514 are repeated seven times until a YES decision is reached by block 512. Block 514 now causes the current contents of the T register 110, the most significant bit of which is now logical 1, to be transferred to the second memory location of the tab switch portion of RAM 86. The bit register 64 is then reset to a 0 value as represented by block 516 and the TRAM pointer 68 and scan register 62 are incremented by factors of unity as represented by blocks 518 and 520. The operational sequence then continues to block 200 and the operations and decisions illustrated in FIG. 4 are repeated.

After all of the tab switches have been scanned, the state of the scan register 62 is equal to the last scan value stored in the RAM 86 and a YES decision is made by block 204 of FIG. 4. This YES decision requires the end of scan mode EOS 600 to be performed. This mode of operation is represented by state latches 58 being characterized by a 001 value.

Figure 7:
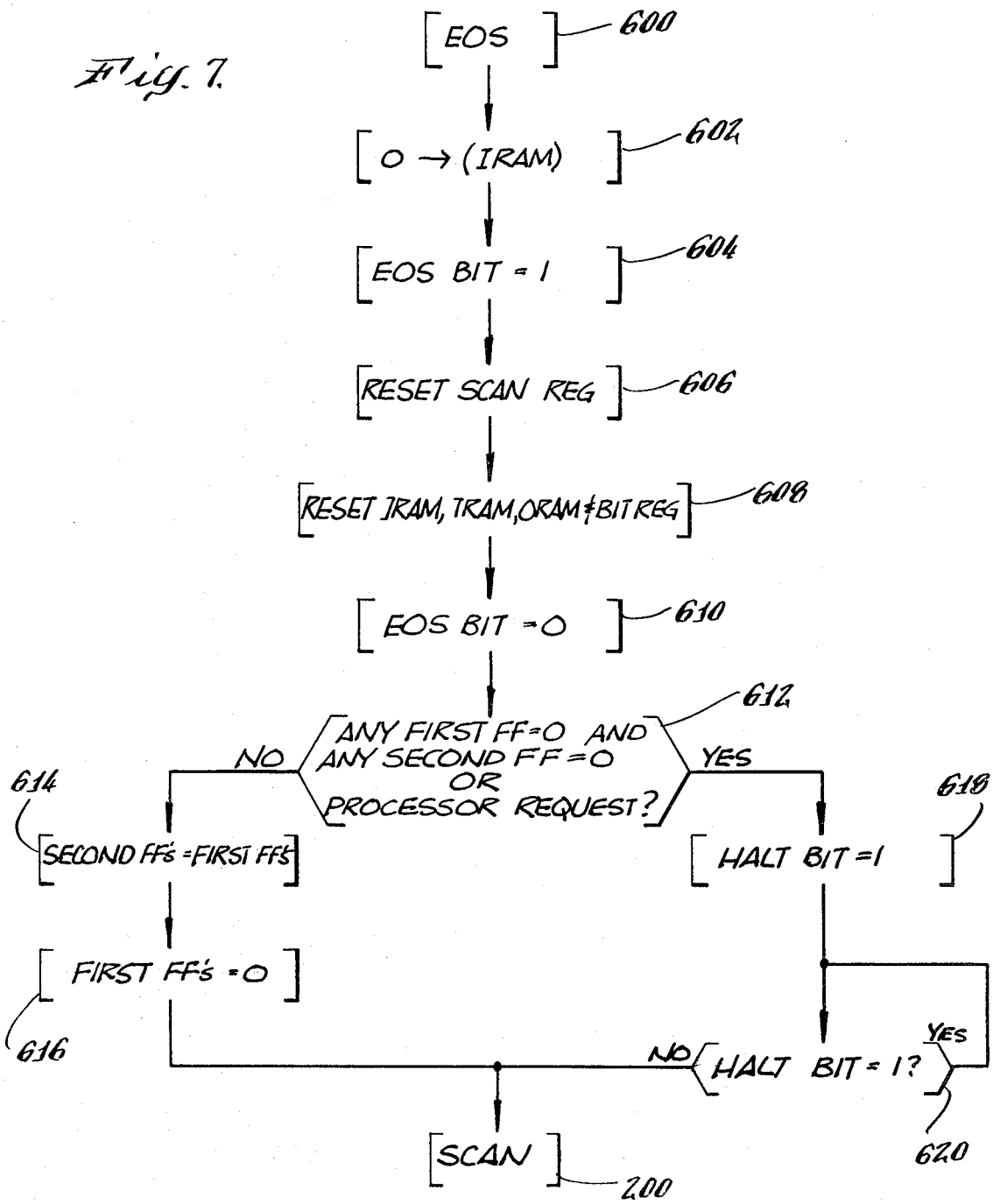

The end of scan operation 600 is illustrated by the flow chart of FIG. 7. The initial operation performed in this mode is represented by block 602 which requires that the memory location of the key switch portion of RAM 86 corresponding to the current state of the IRAM pointer 70 be set to 0. Since the IRAM pointer 70 has been incremented once, the second memory location of the key switch portion of RAM 86 is therefore set to 0. Next, as represented by block 604, an end of scan (EOS) bit is set to 1. This operation corresponds to setting a latch of latches 122 causing the EOS conductor 126 to assume a logical 1 value. Thereafter, as represented by blocks 606 and 608, the scan register 62 is reset as well as the IRAM register 70, the TRAM register 68, the ORAM register 66 and the bit register 64. In the following operation represented by block 610, the EOS bit is reset to 0 whereby the signal on conductor 126 goes logically low. Therefore, as a result of the operations represented by blocks 604 and 610 a narrow pulse is developed on conductor 126 representing the end of the first scan of the key and tab switches 10.

The next step in the end of scan mode of operation requires the decision represented by block 612 to be made. The decision represented by block 612 requires a determination to be made in accordance with the interconnections of the flip-flops of status register 124 as to whether either the first key change flip-flop or the first tab change flip-flop is logical 0 and whether either of a second key change flip-flop or a second tab change flip-flop is logical 1. The second key change flip-flop and the second tab change flip-flop are located in the status register 124 together with the two first flip-flops and have not yet been set so that their states are both logical 0. Therefore, since both first flip-flops are currently logical 1 and both second flip-flops are currently logical 0, a NO decision is made in response to block 612. As represented by block 614 this NO decision initiates an operation whereby the second key change flip-flop is caused to assume the state of the first key change flip-flop and the second tab change flip-flop is caused to assume the state of the first tab change flip-flop. Block 616 then initiates an operation wherein both first flip-flops are reset to 0. Therefore, after the operation represented by block 616, the state of both second flip-flops is logical 1 while the state of both first flip-flops is logical 0. This completes the EOS mode of operation 600 and the serial interface circuit 26 is returned to the scan mode of operations 200 for initiating another scan of the key and tab switches 10. At this time, the first memory location of the key switch portion of RAM 86 is storing an 8-bit binary value representing the time encoded position of the depressed key with the next memory location containing a 0 value byte. The first memory location of the tab switch portion of RAM 86 is storing eight 0 bits representing that the first eight scanned tab switches are undepressed. The second memory location of this portion of RAM 86 is storing an 8-bit word whose most significant bit is logical 1 with the remaining bits being logical 0 indicating that the ninth scanned tab switch was depressed with the next consecutive seven tab switches being undepressed. The remaining memory locations of the tab switch portion of RAM 86 are all logical 0 representing that no additional tab switches were depressed.

Referring back to FIG. 4, the second scan of the key and tab switches 10 places the circuit 26 in the KEYS mode of operation 400 as required by the NO decision of decision block 202. Referring to the KEYS mode of operation illustrated in FIG. 5, a NO decision is made by block 402 until the scan proceeds to the point where a serial data pulse is developed on conductor 14 representing the depressed keyboard key. For each of the these NO decisions, a NO decision is also made by the next block 404 since the state of the scan register 62 has not yet achieved a value corresponding to the contents of the first memory location of the key switch portion of RAM 86 which corresponds to the time encoded position of the depressed key. As a consequence, the scan register 62 is incremented in response to block 406 and the circuit continues to scan the key switches.

When the state of the scan register has been incremented to a value corresponding to the time encoded position of the depressed key a serial data pulse is developed on conductor 14 necessitating a YES decision from block 402 of FIG. 5. At this point, the first memory location of the key switch portion of RAM 86 is equal to the state of scan register 62 whereby a YES decision is reached by block 408 and blocks 410 and 412 are bypassed so that the sequential operation of the circuit 26 proceeds to the operation required by block 414. As a consequence, the IRAM pointer 70 is incremented after which the scan register is incremented (block 406) and the scan continued. For each remaining scanned key switch, the KEYS mode of operation 400 follows the operational sequence represented by blocks 402, 404 and 406.

In response to the state of the scan register 62 being incremented to the time encoded position representing the first scanned tab switch a YES decision results from block 202 of FIG. 4 as reflected by the development of an output signal on conductor 120 of comparator 104. This YES decision places the circuit 26 in its TABS mode of operation 500. Referring to the TABS mode of operation illustrated in FIG. 6, the eight 0 value bits stored in the first memory location of the tab switch portion of RAM 86 are initially loaded into the T register 110 as represented by block 502. Next, in response to block 504, the serial data signal on conductor 14 is compared with the most significant bit stored in the T register 110 by comparator 130. Since both the serial data signal and the most significant bit stored in the T register are both logical 0 a YES descision results whereby the T register 110 is shifted one bit in response to a shift signal on conductor 132 and the bit register 64 is incremented as represented by blocks 508 and 510. Since the contents of the bit register 64 does not equal 8, a NO decision results from block 512 and the scan register 62 is incremented in accordance with block 514. An identical operational sequence is followed for the next seven scanned tab switches. In response to the eighth scanned tab switch the state of the bit register 64 will have been incremented to a value of 8 whereby a YES decision results from block 512. As a consequence, the contents of the T register 110, reflecting the undepressed condition of the first eight scanned tab switches, is transferred to the first memory location of the tab switch portion of RAM 86 as represented by block 514. Also, as represented by blocks 516, 518 and 520, the bit register 64 is reset to 0, the TRAM pointer 68 is incremented and the scan register 62 is incremented.

The TABS mode of operation 500 is now repeated for the next eight scanned tab switches. In particular, as represented by block 502 the contents of the second memory location of the tab switch portion of RAM 86 is transferred to the T register 110. Consequently, the state of T register 110 is characterized by a logical 1 bit in its most significant position with the remaining bits being logical 0. At this time, a serial data pulse is developed on conductor 14 which is compared with the most significant bit stored in the T register 110 by comparator 130 resulting in a YES decision from block 504. As a consequence, the operation represented by block 506 is bypassed and the operational sequence of circuit 26 follows a path represented by blocks 508, 510, 512 and 514 back to block 504. Since all of the subsequent serial data developed on conductor 14 is logical 0 as well as the remaining bits stored in the T register 110, the operational sequence of circuit 26 will likewise proceed in response to a YES determination by block 504. The remaining tab switches will be scanned as previously described until the state of the scan register 62 corresponds to the value stored in RAM 86 representing the time encoded position of the last scanned tab switch whereby the EOS mode of operation 600 will be initiated.

Referring to FIG. 7, in the EOS mode of operation the second memory location of the key switch portion of RAM 86 is set to 0 as represented by block 602 and an EOS pulse is developed on conductor 126 in response to the operations represented by blocks 604 and 610. Also, the scan register 62, the IRAM register 70, the TRAM register 68, the ORAM register 66 and the bit register 64 are all reset as represented by blocks 606 and 608. Recalling that neither the first key change flip-flop nor the first tab change flip-flop of status register 124 had been set during the second scan of key and tab switches 10 and that both the second key change flip-flop and the second tab change flip-flop of register 124 had been set to logical 1 at the end of the first scan, a YES decision results from block 612 causing a HALT bit to be set to logical 1 as represented by the operation of block 618, the HALT bit being stored in another flip-flop located in status register 124. Next, block 620 compares the state of the HALT bit to logical 1 and, if the comparison yields a YES answer, the comparision of block 620 is repeated. Since the HALT bit had previously been set to logical 1 in response to the operation represented by block 618, the effect of block 620 is to repeatedly cause the decision represented by block 620 to be made thereby inhibiting further operation of the serial interface circuit 26. Referring to FIG. 2, the HALT bit is coupled from status register 124 to the state latches 58 over conductor 142 to identify the HALT mode of operation and also serves to enable the buffer gate 112 as well as multiplexers 98 and 118. The microprocessor 28 periodically samples the state of the HALT bit stored in register 124 and, in response to a logical 1 HALT bit, reads the data in RAM 86 representing the depressed key switch and the depressed tab switch via bus 108 and enabled buffer gate 112. After reading the data, the microprocessor 28 resets the HALT bit to logical 0 and clears both the second key change flip-flop and the second tab change flip-flop of register 124. Thus, at the end of the second scan the states of all of the flip-flops of status register 124 are logical 0. Also, since RAM 86 provides non-destructive read-out, the first memory location of the key switch portion of the memory continues to store the value of the time encoded position of the depressed key with the next memory location storing a logical 0 value signal. Also, the most significant bit of the second memory location of the tab switch portion of RAM 86 continues to store a logical 1 signal representing the depressed tab switch with the remainder of this portion of the memory storing logical 0 bits.

In response to the HALT bit being reset by the microprocessor 28, a NO decision is produced in response to block 620 whereby the third consecutive scan of the key and tab switches 10 is initiated. It will be assumed that during the third scan the key switch and the tab switch depressed during the previous two scans both remain depressed. Consequently, NO decisions result from blocks 402 and 404 (FIG. 5) until the scan register has been incremented to a value corresponding to the time encoded position of the depressed key which is still stored in the first memory location of the key switch portion of the RAM 86. At this time, block 402 yields a YES decision as does block 408 whereby the IRAM register 70 and the scan register 62 are incremented in accordance with blocks 414 and 406 while the operation of blocks 410 and 412 are bypassed. The remaining portion of the KEYS mode of operation proceeds exactly as previously described with respect to the second scan.

Upon completion of the KEYS mode of operation, the TABS mode of operation (see FIG. 6) is initiated as before. The TABS mode of operation proceeds exactly as described with respect to the second scan with block 506 being bypassed each time the operational sequence is repeated in response to the scan register 62 being incremented. Therefore, when the EOS mode of operation (see FIG. 7) is subsequently initiated both the first key change flip-flop and the first tab change flip-flop as well as the second key change flip-flop and the second tab change flip-flop of register 124 are logical 0. As a result, a NO decision is reached in response to block 612 and the next scan is initiated. Since the HALT bit stored in status register 124 was not set in response to the third scan the microprocessor 28 does not attempt to read the data stored in RAM 86. This allows the microprocessor 28 to continue its internal operations without stopping to read data which it had previously read. As a matter of fact, for each subsequent scan of the key and tab switches 10 during which the previously depressed key and tab switches remain depressed, the serial interface circuit 26 will follow an identical sequence of operations which do not result in the setting of the HALT bit. As a result, as long as the key switch and tab switch are depressed the micriprocessor 28 will not interrupt its operation to read the data stored in RAM 86.

Now, during some subsequent scan, assume that the depressed key switch is released and that the depressed tab switch is returned to its off position. In this case, block 402 in the KEYS mode of operation (FIG. 5) will yield a NO decision in response to each key switch scanned since none of the key switches are depressed. Moreover, block 404 will yield a NO decision in response to each scanned key except for the key which was previously depressed and released during the scan. For the latter key, a YES decision results and the first key change flip-flop of status register 124 is set to logical 1 as represented by block 416. Also, it will be observed that the IRAM register 70 is not incremented from its initial position since block 414 is bypassed for each scanned key switch.

In the following TABS mode of operation (FIG. 6), a YES decision results from block 504 for every scanned tab switch except the one previously depressed and released during the present scan. The NO decision resulting from block 504 for the released tab switch causes the first tab change flip-flop of status register 124 to be set to logical 1. At the end of the TABS mode of operation all of the memory locations of RAM 86 store 0 value bits since the serial data developed on conductor 14 and transferred to RAM 86 through the T register 110 was logical 0.

In the end of scan mode (see FIG. 7), the initial memory location of the key switch portion of RAM 86 is set to 0 as represented by block 602 and block 612 yields a NO decision since both the first key change flip-flop and the first tab change flip-flop of status register 124 were previously set to logical 1. Consequently, both the second key change flip-flop and the second tab change flip flop of status register 124 are set to logical 1 and the first key change and tab change flip-flops are cleared as represented by blocks 614 and 616. Since the HALT bit was not set to logical 1, the microprocessor 28 does not read the data stored in RAM 86, which data represents the condition of no depressed keys and no depressed tab switches.

During the succeeding scan, assuming that no two switches or tab switches are depressed, the KEYS mode of operation follows an operational sequence from block 402 to block 404 and therefrom to block 406 bypassing the operation represented by block 416. Also, the decision represented by block 408 and the operations represented by blocks 410, 412 and 414 are similarly bypassed. During the TABS mode of operation, the operational sequence proceeds from a YES decision by block 504 to block 508 bypassing the operation of block 506 for each scanned tab switch. Now, during the end of scan mode of operation, block 612 yields a YES decision since both first flip-flops of status register 124 are logical 0 and both second change flip-flops of status register 124 are logical 1. This results in the setting of the HALT bit to logical 1 wherein the operational sequence of the serial interface circuit 26 is suspended and the microprocessor 28 reads the 0 value data stored in RAM 86 representing the condition that the previously depressed key and tab have been released. It will be observed that three complete scans of the key and tab switches 10 must transpire before a HALT bit is developed enabling the microprocessor for reading the data stored in the RAM 86. In particular, two consecutive scans of identical serial data on conductor 14 immediately preceded by a scan representing different serial data on conductor 14 must transpire before the HALT bit is set to logical 1. In this manner, a level of confidence is achieved that valid data is being read into the microprocessor 28 which was generated in response to key and tab switch depressions and not in response to key bounce.

As a further example of the operation of the serial interface circuit 26, assume that three different key switches have been depressed for a number of consecutive scans. As a result, the time encoded position of the three depressed keys will be stored in the first three consecutive memory locations of the key switch portion of the RAM 86. The fourth memory location will store a logical 0 value signal due to the operation represented by block 602 of FIG. 7. The three data values representing the three depressed keys will also have been read into the microprocessor 28 in response to the HALT bit of status register 124 having previously been set.

Assume now that during some succeeding scan only one of the depressed keys, the key corresponding to the time encoded data value stored in the middle or second memory location of the key switch portion of RAM 86, is released. With reference to FIG. 5, for each value of scan register 62 less than the time encoded position of the first depressed key, both blocks 402 and 404 yield NO decisions so that the IRAM register 70 is not incremented. When the state of the scan register 62 achieves a value corresponding to the time encoded position of the first depressed key YES decisions result from both block 402 and 408 whereby the IRAM register 70 is incremented for pointing to the second memory location of the key switch portion of RAM 86. Upon the state of scan register 62 achieving a value equal to the time encoded position of the previously depressed but now released key, block 402 yields a NO decision since no serial data is present on conductor 14 and block 404 yields a YES decision since the second memory location of the key switch portion of RAM 86 is storing a value equal to the state of the scan register 62. As a consequence, the first key change flip-flop of status register 124 is set to logical 1. Now, in response to the state of scan register 62 being incremented to a value equal to the time encoded position of the final depressed key, a YES decision is reached by block 402 due to the serial data pulse developed on conductor 14. However, since the IRAM register 70 is pointing to the second memory location of the key switch portion of RAM 86, a NO decision is made in response to block 408. As a result, the first key change flip-flop of status register 124, which had already been set to logical 1, is again attempted to be set to a state of logical 1. Also, the contents of the scan register 62 is transferred to the second memory location of the key switch portion of RAM 86 in response to block 412. The IRAM register 70 is then incremented and the scan of the remaining key and tab switches is completed.

During the end of scan mode (see FIG. 7), the third memory location of the key switch portion of RAM 86 is set to a 0 value in response to block 602. Thus, it will be observed that the data stored in the RAM 86 is compressed such that the time encoded positions corresponding to the two remaining depressed keys are stored in the first two memory locations of the key switch portion of RAM 86 with the next memory location storing a 0 value signal. The efficient use of the memory locations of RAM 86 is thereby maximized. Continuing with the end of scan mode of operation, block 612 yields a No decision since the first key change flip-flop of status register 124 had been set to logical 1. As a result, the second key change flip-flop is set to logical 1 as represented by block 614 and the first key change flip-flop is cleared as represented by block 616. Since the HALT bit has not been set to logical 1 the microprocessor 28 does not at this time read the data stored in RAM 86.

During the KEYS mode of operation of the next succeeding scan, a YES decision is made in response to block 402 upon the occurrence of each serial data pulse on conductor 14 identifying one of the two depressed keys. Otherwise, a NO decision is made by block 402 and also by block 404 whereby block 416 is bypassed so that the first key change flip-flop of status register 124 is not set to logical 1. For each of the two YES decisions made by block 402, block 408 also makes a YES decision such that blocks 410 and 412 are bypassed wherein the first key change flip-flop remains in a logical 0 state and the contents of the key switch portion of RAM 86 are not altered. During the end of scan mode of operation of this scan, a YES decision is now made by block 612 resulting in the setting of the HALT bit of status register 124 to logical 1. The microprocessor 28 therefore reads the data stored in the RAM 86 which reflects the new condition of the key switches wherein one of the originally depressed keys has been released. Again, a de-bounce function is performed since two consecutive scans of identical serial data on conductor 14 immediately preceded by a scan presenting different serial data on conductor 14 was required before the microprocessor was allowed to read the stored information from RAM 86.

Returning to FIG. 4, section 300 of the depicted flow chart will now be explained. Initially, an operation represented by block 302 is performed each time the scan register 62 is incremented. This operation consists of complementing the state of a scan clock latch of latches 122 for producing a scan clock signal on output conductor 128. The remaining operations and decisions performed by section 300 deal with the development of serial data on the serial data output conductor 32 of latches 122. Before discussing this aspect of the circuit, it is necessary to explain the function of the PROCESSOR REQUEST indicated in block 612 in the end of scan mode illustrated in FIG. 7. The status register 124 includes an additional flip-flop referred to as a processor request flip-flop which may be set to a logical 1 state by the microprocessor 28 at any time the microprocessor wishes to transfer data into one or more of the forty 8-bit output memory locations of the RAM 86. The effect of setting the processor request flip-flop is a YES decision by block 612 causing the HALT bit to be set to logical 1 and the operation of the serial interface circuit 26 to be temporarily halted, At this time, the microprocessor 28 can transfer data developed, for example, in response to different internal calculations performed by the processor to the output memory locations of the RAM 86.

With reference again to FIG. 4, the comparator 104 compares the data stored in the first output memory location of RAM 86 with the current state of the scan register 62. If the two values are not equal, a NO decision results and a serial output latch of latches 122 is reset to 0 whereby a logical 0 signal is developed on the serial data output conductor 30. When the scan register 62 has been incremented to a value equal to the data stored in the first output memory location of RAM 86 a YES decision is made in response to the comparison represented by block 304 and the serial output latch of latches 122 is set to logical 1 as represented by block 308. This causes the serial data output conductot to assume a logical 1 state. Thereafter, the ORAM register 66 is incremented and the foregoing process is repeated for each subsequent value assumed by the scan register 62. The result of the foregoing is the development of a non-return-to-zero (NRZ) serial data output signal on conductor 30 representing the data values which were transferred by the microprocessor 28 to the RAM 86. The serial data output signal may be used for various purposes within the organ such as controlling the operation of the keyers 18.

While particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention.

We claim:

1. In an electronic musical instrument of the type having a programmed microprocessor for controlling selected functions of said instrument and a plurality of key and tab switches responsive to a scan control signal repetitively scanning said switches for developing a serial data signal defining the operated key and tab switches during each of said scans, an interface circuit interposed between said microprocessor and said switches comprising:

means for developing a clock signal;

means responsive to said clock signal for developing said scan control signal;

means coupled to said switches for receiving said serial data signal developed in response to said scan control signal;

memory means comprising a plurality of addressable multibit memory locations;

means responsive to said received serial data signal for causing binary representations of operated ones of said key and tab switches to be stored at said memory locations; and means enabling said stored representations to be coupled to said microprocessor from said memory means in response to two consecutive scans of said key and tab switches resulting in the development of identical serial data signals immediately preceded by a scan resulting in the development of a serial data signal different therefrom.

2. The interface circuit according to claim 1 wherein said means enabling comprises a buffer gate connected between said memory means and said microprocessor and register means for enabling said buffer gate in response to two consecutive scans of said key and tab switches resulting in the development of identical serial data signals immediately preceded by a scan resulting in the development of a serial data signal different therefrom.

3. In an electronic musical instrument of the type having a programmed microprocessor for controlling selected functions of said instrument and a plurality of key and tab switches responsive to a scan control signal repetitively scanning said switches for developing a serial data signal defining the operated key and tab switches during each of said scan, an interface circuit interposed between said microprocessor and said switches comprising:

means for developing a clock signal;

means responsive to said clock signal for developing said scan control signal;

means coupled to said switches for receiving said serial data signal developed in response to said scan control signal;

memory means comprising a plurality of addressable multibit memory locations;

means responsive to said scan control signal for converting said received serial data signal into a number of first multibit words each representing a depressed one of said keys and a predetermined number of second multibit words, each bit of each of said second multibit words representing the operational condition of one of said tab switches; and means for coupling said first and second multibit words for storage at respective memory locations of said memory means.

4. The interface circuit according to claim 3 including a multibit scan register incrementable in response to said clock signal for developing said scan control signal, the state of said scan register during the receipt of said serial data signal defining an operated one of said keys representing the corresponding one of said first multibit words.

5. In an electronic musical instrument of the type having a programmed microprocessor for controlling selected functions of said instrument and a plurality of key and tab switches responsive to a scan control signal repetitively scanning said switches for developing a serial data signal defining the operated key and tab switches during each of said scans, an interface circuit interposed between said microprocessor and said switches comprising:

means for developing a clock signal;

means responsive to said clock signal for developing said scan control signal;

means coupled to said switches for receiving said serial data signal developed in response to said scan control signal;

memory means comprising a plurality of addressable multibit memory locations;

means responsive to said scan control signal for converting said received serial data signal into a number of multibit words each representing a depressed one of said keys; and means for coupling said multibit words for storage at respective consecutive memory locations of said memory means regardless of the manner of operation of said keys.

6. The interface circuit according to claim 5 including a multibit scan register incrementable in response to said clock signal for developing said scan control signal, the state of said scan register during the receipt of said serial data signal defining an operated one of said keys representing the corresponding one of said multibit words.

7. In an electronic musical instrument of the type having a programmed microprocessor for controlling selected functions of said instrument and a plurality of key and tab switches responsive to a scan control signal repetitively scanning said switches for developing a serial data signal defining the operated key and tab switches during each of said scans, an interface circuit interposed between said microprocessor and said switches comprising:

means for developing a clock signal;

means responsive to said clock signal for developing said scan control signal;

memory means having a plurality of multibit memory locations;

means operable for coupling output multibit data words from said microprocessor for storage at respective memory locations of said memory means; and means for comparing each of said stored output multibit data words with said scan control signal, said means for comparing having an output line developing an output serial data signal having a first logic state in response to an equality comparison and otherwise having a second logic state, said second logic state being the complement of said first logic state.

* * * * *